United States Patent [19]

Yackiw et al.

[11] Patent Number: 4,528,788

[45] Date of Patent: Jul. 16, 1985

[54] WEATHERPLUG FOR A MOVEABLE PANEL

[75] Inventors: Charles Yackiw, Fairport, N.Y.; Jeffrey M. Lynn, Marine-on-St. Croix

[73] Assignees: Schlegel Corp., Rochester, N.Y.; Andersen Corp., Bayport, Minn.

[21] Appl. No.: 471,210

[22] Filed: Mar. 1, 1983

[51] Int. Cl.[3] ..... E06B 1/04

[52] U.S. Cl. ..... 52/207; 52/397; 52/403; 49/406

[58] Field of Search ..... 52/207, 393, 394, 397, 52/398, 400, 401, 402, 403; 49/406, 495, 496

[56] References Cited

U.S. PATENT DOCUMENTS

| | | | |
|---|---|---|---|
| 1,562,213 | 11/1925 | Fien | 49/406 |
| 2,067,118 | 1/1937 | Case | 49/406 |
| 3,111,727 | 11/1963 | Gerecke | 52/207 |
| 3,325,944 | 6/1967 | Crain | 49/466 |
| 3,359,688 | 12/1967 | Konolf | 49/496 |
| 3,652,380 | 3/1972 | Strack | 52/397 |
| 4,138,807 | 2/1979 | Trachtenburg | 52/394 |
| 4,302,262 | 11/1981 | Kay | 49/495 |
| 4,379,379 | 4/1983 | Sengoku | 52/401 |

FOREIGN PATENT DOCUMENTS

| | | | |
|---|---|---|---|
| 2546101 | 5/1977 | Fed. Rep. of Germany | 52/403 |
| 35439 | 3/1977 | Japan | 49/506 |
| 2095734A | 10/1982 | United Kingdom | 49/406 |

*Primary Examiner*—John E. Murtagh
*Assistant Examiner*—Andrew Joseph Rudy
*Attorney, Agent, or Firm*—Cumpston & Shaw

[57] ABSTRACT

A unitary weatherplug in combination with a moveable panel, such as a door or window, for sealing the space between a sill and the undersurface of a portion of the moveable panel. The weatherplug comprises a unitary body of soft resilient material having a bottom surface affixed to the sill, and an upper curved surface engageable by the undersurface of the moveable panel.

5 Claims, 5 Drawing Figures

WEATHERPLUG FOR A MOVEABLE PANEL

BACKGROUND OF THE INVENTION

1. Field of the Invention

The present invention relates to weather seals, and more particularly to a weatherplug for sealing the space between a sill and the undersurface of a moveable panel, such as a door or window, in its closed position.

2. Description of the Prior Art

U.S. Pat. No. 1,562,213 relates to a double hung metal window, and particularly to a structure for sealing the window at the point where the upper and lower sashes overlap.

U.S. Pat. No. 2,067,118 relates to a plug for sealing sliding doors such as are employed in refrigerated display cases.

U.S. Pat. No. 3,325,944 discloses a spring-loaded window sealing device for sealing the edge of a double hung window to the track in which the window rides.

With many sliding panels, such as patio doors and windows, a space exists between the undersurface of a sliding panel and supporting sill when the panel is in its closed position. Dust, moisture or the like may leak through this space into the adjoining room.

SUMMARY OF THE INVENTION

It is a primary object of the present invention to provide a weatherplug for sealing the space between the undersurface of a sliding panel, such as a door or window, and supporting sill when the panel is closed.

In accordance with a preferred embodiment of the invention, the weatherplug comprises a body of soft resilient material. The body has a substantially quadrilateral section having a bottom engageable with the sill and a top surface engageable with the undersurface of the panel.

In a more specific aspect of the invention, the weatherplug has a rectangular section in which one side thereof is common with a part of the quadrilateral section. In addition, three sides of the rectangular section, which are perpendicular to the common side, are integral with and lie in the same plane as three corresponding sides of the quadrilateral section.

In further aspects of the invention, the quadrilateral section is hollow, and the top surface is sloped and coated with a layer of polyester fiber.

The invention and its advantages will become more apparent from the detailed description of the invention presented below.

BRIEF DESCRIPTION OF THE DRAWINGS

The details of the invention will be described in connection with the accompanying drawings, in which.

DETAILED DESCRIPTION OF THE INVENTION

Figure 1:
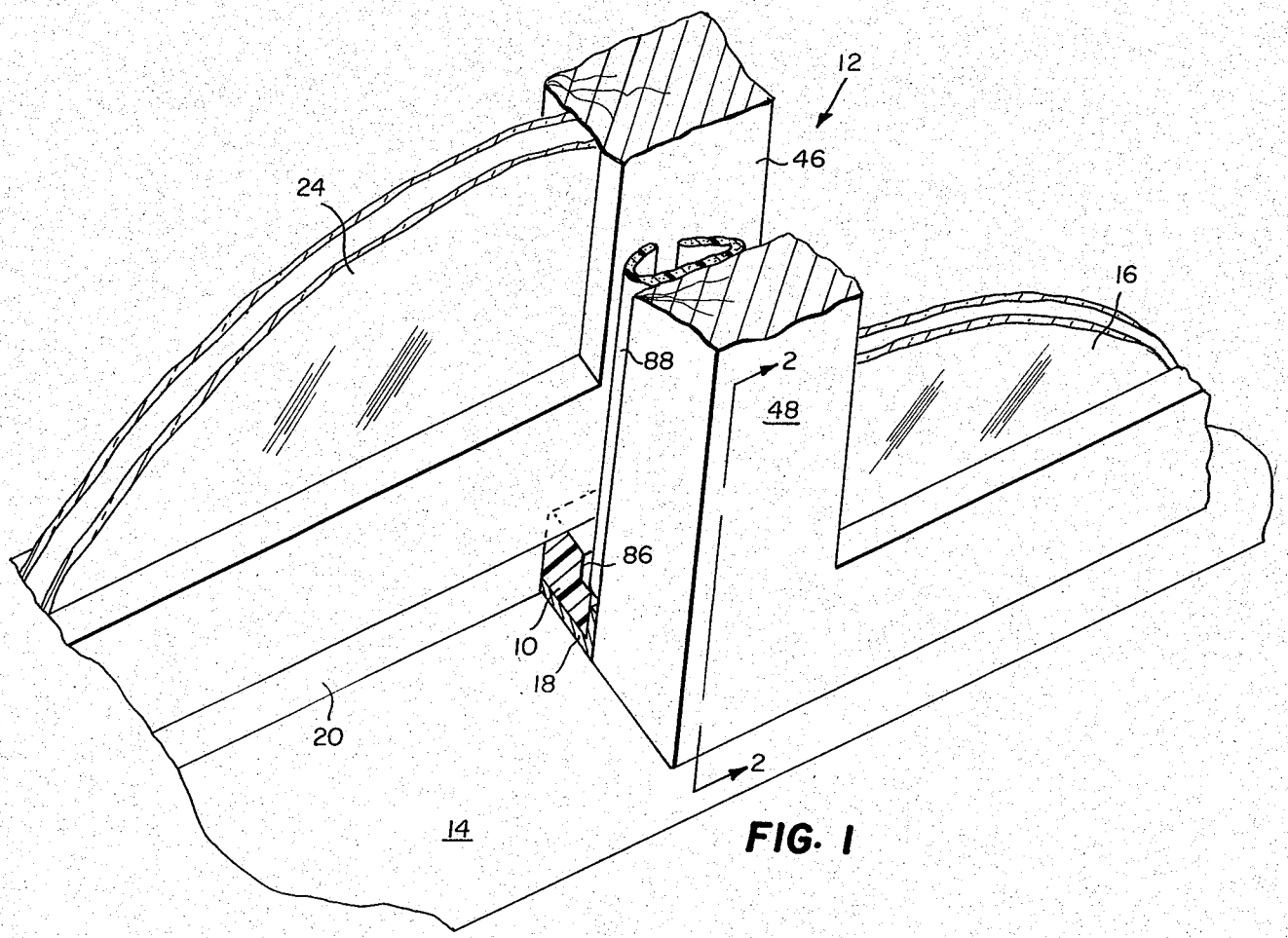
FIG. 1 is a segmental perspective view of a slideable door or window unit in its closed position, and showing a weatherplug for sealing the space between the sill and undersurface of the sliding panel.
Figure 2:
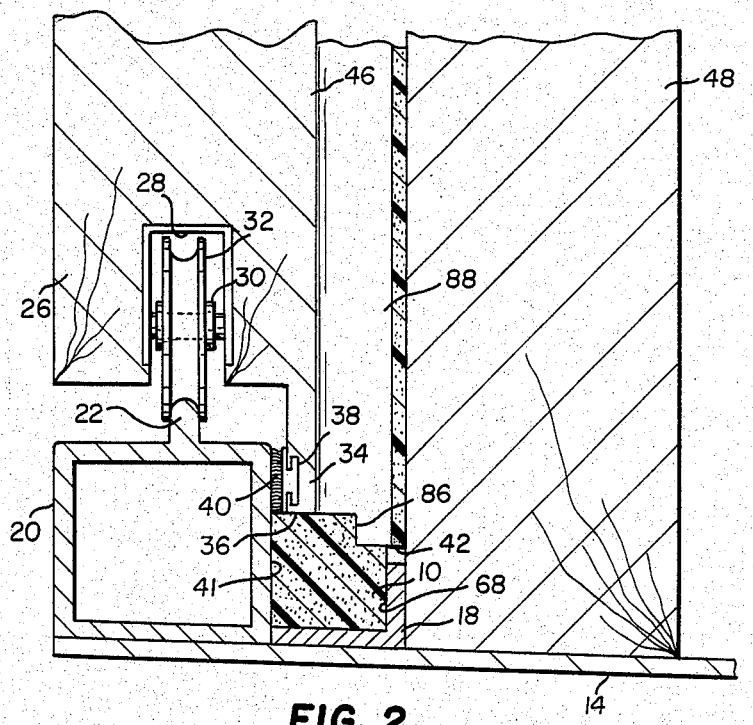
FIG. 2 is a section view taken substantially along line 2—2 of FIG. 1.

With reference to FIGS. 1 and 2, a preferred embodiment of a weatherplug 10 of this invention is shown incorporated in a conventional sliding door or window unit 12, for example. While the invention is described in connection with a sliding door, it will be appreciated by those skilled in the art that it will be readily employed in connection with a sliding window without substantial modification.

The door unit 12 has a sill member 14, and a window sash 16 fixed to sill member 14 by a 90° angle strip 18 secured to the sill member and sash 16 by screws, not shown. The sill member 14 further has an elongated hollow support member 20 of square-shaped cross-section having an elongated rail 22 on the upper surface thereof. The door unit 12 has a slideable panel 24 moveable between open and closed positions relative to fixed sash 16. The lower horizontal sash member 26 of slideable panel 24 has an undersurface portion provided with a pair of blind bores 28, only one of which is shown in FIG. 2. A lever 30 having rollers 32 at each end thereof is pivotally mounted in each bore 28 to horizontal sash member 26. The panel 24 is mounted in door unit 12 with rollers 32 slidably mounted on rail 22 to facilitate slideable movement of moveable panel 24 between its open and closed positions.

Horizontal sash member 26 further has a depending lip 34 (FIG. 2) having an undersurface 36 in sliding engagement with a top surface of weatherplug 10. Lip 34 has a T-shaped slot 38 for holding a weatherstrip 40 of H-shaped cross section in sliding engagement with an outer surfce 41 of support member 20.

When door unit 12 is in its closed position, as seen in FIGS. 1 and 2, a space through which air, moisture, dirt, or the like can pass through the door unit is defined by the upper surface of sill 14, undersurface 36 of horizontal sash member lip 34, outer surface 41 of support member 20, and facing surfaces 42, 44 of vertical sash members 46, 48 respectively. This leakage space is substantially effectively blocked by a preferred embodiment of the weatherplug 10 of this invention, now to be described.

Figure 4:
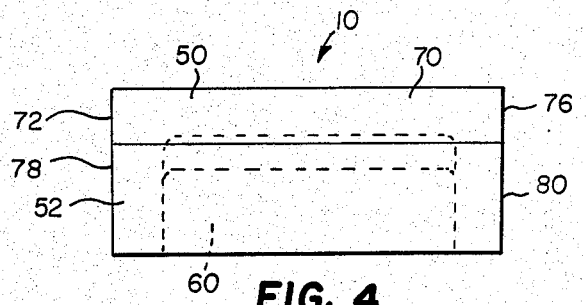
FIG. 4 is a top plan view of the weatherplug of FIG. 3.
Figure 3:
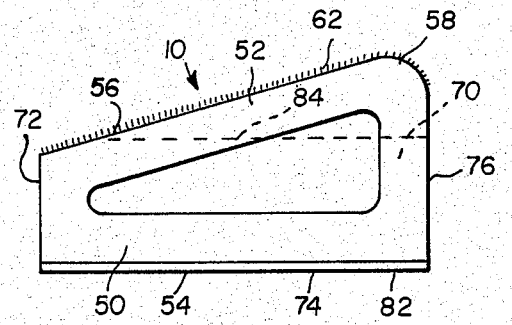
FIG. 3 is a side elevational view of a weatherplug.
Figure 5:
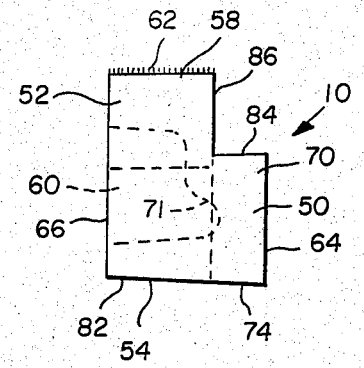
FIG. 5 is an end view of the weatherplug of FIG. 3.

With reference to FIGS. 3–5, weatherplug 10 comprises a unitary body 50 of soft resilient material, such as rubber, foamed rubber, or a foamed synthetic resin material, for example, of which polyurethane is preferred. The body 50 has a quadrilateral section 52 having a slightly inclined bottom surface 54 secured by any suitable means to sill 14, as best seen in FIG. 2. The body 50 has a sloping top surface 56 to provide a curved resilient portion 58 engageable by the undersurface 36 of lip 34 of moveable panel 24. The body 50 is further hollow or provided with a blind cavity 60 for increasing the flexibility of the top portion. In order to increase the wearability of top portion 58, the surface thereof is flocked or provided with a layer 62 of natural or synthetic fiber, such as NYLON ® or DACRON or other suitable polyester or polyamide materials. The sides 64, 66 of body 50 are slightly oversized and sealingly engage the facing surfaces 41, 68 of support member 20 and angle strip 18, respectively. Such sealing engagement is enhanced by depression of top portion 58 by the undersurface 36 of horizontal sash member 26.

Weatherplug 10 further has a rectangular section 70 integral with quadrilateral section 52 along a common plane 71, shown dotted in FIG. 5. Rectangular section 70 has three sides 72, 74, 76 substantially perpendicular to the common plane 71, and integral with and in the same side plane as corresponding three sides 78, 80, 82 of quadrilateral section 52. The fourth side 84 of rectangular section 70 (FIGS. 3 and 5) has one end thereof that substantially merges with one end of sloping top surface 56, and the opposite end thereof located below the opposite end of top surface 56 to form a notch 86, as best seen in FIG. 5. The notch 86 receives one end of an elongated, flexible weatherstrip 88, of substantially C-shaped cross section. Weatherstrip 88 has its central longitudinally extending portion secured to a surface of upright sash member 48 and its free longitudinally extending edges engaging the surface of sash member 46 for sealing the space between the facing surfaces of upright sash members 46, 48 in their closed position, as seen in FIGS. 1 and 2.

While the presently preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

We claim:

1. A slideable sealed panel unit comprising:

a sill member;

a first fixed vertical sash member;

an elongated flexible weatherstrip adjacent said sash member, a moveable panel slidably mounted on said sill member and having an undersurface;

a second vertical sash member on said moveable panel; and a unitary weatherplug of soft resilient material mounted on said sill member, said weatherplug having sides thereof sealingly engaging facing surfaces of said first and second sash members, said weatherplug further having a flexible curved top portion engageable by said undersurface of said moveable panel and a notch adjacent said top portion, said notch engaging said flexible weatherstrip.

2. A slideable sealed panel according to claim 1 wherein said weatherplug is hollow.

3. A slideable sealed panel according to claim 1 wherein said top surface is coated with a layer of polyester fiber.

4. A slideable sealed panel according to claim 1 and further having a weatherstrip on said facing surface of said first sash member, said weatherplug further being formed of a foamed material, and having a hollow quadrilateral section and a rectangular section integrally joined along a common plane, said rectangular section having three sides perpendicular to said common plane and integral with and in the same side plane as corresponding three sides of said quadrilateral section, and said top portion is coated with a layer of polyester fiber and has one end thereof merging with one end of the fourth side of said rectangular section, and the opposite end of said top portion extending above the opposite end of the fourth side of said rectangular section to form an L-shaped notch for receiving one end of said weatherstrip.

5. A weatherplug according to claim 4 wherein said foamed material is selected from the group consisting of foamed rubber and foamed synthetic resin.

* * * * *